United States Patent [19]

Grunert et al.

[11] Patent Number: 4,990,873

[45] Date of Patent: Feb. 5, 1991

[54] REVERSE SWITCHING MEANS FOR MOTOR OPERATOR

[75] Inventors: Kurt A. Grunert, Beaver; Charles R. Paton, New Brighton, both of Pa.

[73] Assignee: Westinghouse Electric Corp., Pittsburgh, Pa.

[21] Appl. No.: 374,370

[22] Filed: Jun. 30, 1989

[51] Int. Cl.[5] ..... H01H 3/00

[52] U.S. Cl. ..... 335/68; 335/14; 335/71

[58] Field of Search ..... 335/30, 68–75, 335/6, 14, 20

[56] References Cited

U.S. PATENT DOCUMENTS

| | | | |
|---|---|---|---|
| 2,864,911 | 12/1958 | Brumfield | 335/69 |
| 2,870,288 | 1/1959 | Schmidt | 335/69 |
| 3,198,907 | 8/1965 | Archer et al. | 335/69 |
| 4,489,295 | 12/1984 | Altenhof et al. . | |
| 4,553,115 | 11/1985 | Grunert et al. . | |
| 4,638,277 | 1/1987 | Thomas et al. . | |
| 4,642,430 | 2/1987 | Tedesco . | |
| 4,642,726 | 2/1987 | Matsko et al. . | |
| 4,656,444 | 4/1987 | McKee et al. . | |
| 4,679,018 | 7/1987 | McKee et al. . | |

*Primary Examiner*—Leo P. Picard
*Assistant Examiner*—L. Donovan
*Attorney, Agent, or Firm*—M. J. Moran

[57] ABSTRACT

A power drive mechanism for a circuit breaker handle which includes a reversible electrical motor, a carriage assembly and a cooperating slide plate assembly mechanically coupled to the motor shaft. The carriage assembly includes a pivotally mounted L-shaped lever, interlocked with the circuit breaker operating handle for driving the operating handle to an on position or alternatively to an off position on command. Microswitches are located at both the on position and the off position for controlling operation of the motor. The microswitches are actuated by the slide plate assembly which, in turn, is driven by the carriage assembly. The slide plate assembly is slidably mounted with respect to the carriage assembly with one or more wave washers. The slide plate assembly provides mechanical damping for the carriage assembly to minimize damage to the microswitches. The slide plate assembly also prevents the contacts in the limit switch from bouncing even though the carriage assembly may oscillate at the end of travel.

14 Claims, 2 Drawing Sheets

W
L

REVERSE SWITCHING MEANS FOR MOTOR OPERATOR

CROSS REFERENCE TO RELATED APPLICATIONS

The invention disclosed herein relates to molded case circuit breakers. The following seven patent applications all relate to molded case circuit breakers and were filed on Aug. 1, 1988: Ser. No. 226,500, entitled RUBBER STOPS IN OUTSIDE POLES, William E. Beatty, Jr., Lawrence J. Kapples, Lance Gula and Joseph F. Changle; Ser. No. 226,648, entitled CT QUICK CHANGE ASSEMBLY, by Jere L. McKee, William E. Beatty, Jr. and Glenn R. Thomas; Ser. No. 226,503, entitled CROSS-BAR ASSEMBLY, by Jere L. McKee, Lance Gula, and Glenn R. Thomas; Ser. No. 226,649, entitled LAMINATED COPPER ASSEMBLY, by Charles R. Paton; Ser. No. 226,650, entitled CAM ROLL PIN ASSEMBLY, by Lance Gula and Jere L. McKee; Ser. No. 226,655, entitled COMBINATION BARRIER AND AUXILIARY CT BOARD by Gregg Nissly, Allen B. Shimp and Lance Gula; and Ser. No. 226,654, entitled MODULAR OPTION DECK ASSEMBLY by Andrew J. Male.

The following four commonly assigned United States patent applications were filed on Oct. 12, 1988 and all relate to molded case circuit breakers: Ser. No. 256,881 entitled SCREW ADJUSTABLE CLINCH JOINT WITH BOSSES, by James N. Altenhof, Ronald W. Crookston, Walter V. Bratkowski, and J. Warren Barkell; Ser. No. 256,879 entitled TAPERED STATIONARY CONTACT LINE COPPER, by Ronald W. Crookston; Ser. No. 256,880, entitled SIDE PLATE TAPERED TWIST-TAB FASTENING DEVICE FOR FASTENING SIDE PLATES TO THE BASE, by K. Livesey and Alfred E. Maier; and Ser. No. 256,878, entitled TWO-PIECE CRADLE LATCH FOR CIRCUIT BREAKER, by Alfred E. Maier and William G. Eberts.

The following commonly assigned United States patent applications also relate to molded case circuit breakers: Ser. No. 260,848, filed on Oct. 21, 1988 entitled UNRIVETED UPPER LINK SECUREMENT, by Joseph Changle and Lance Gula; Ser. No. 07/331,769, filed on Apr. 3, 1989, entitled ARC RUNNER CONTAINMENT SUPPORT ASSEMBLY, by Charles Paton, Kurt Grunert and Glen Sisson; and Ser. No. 07,331,920, filed on Mar. 31, 1989 entitled EXTENDER SPRING FOR INCREASED MAGNETIC TRIP SETTINGS, by Kurt Grunert.

Lastly, the following two commonly owned patent applications were filed on Apr. 25, 1989: Ser. No. 07/343,047, entitled TWO-PIECE CRADLE LATCH, KEY BLOCKS AND SLOT MOTOR FOR CIRCUIT BREAKER, by Alfred E. Maier, William G. Eberts and Richard E. White, and Ser. No. 07/342,820, entitled TWO-PIECE CRADLE LATCH, HANDLE BARRIER LOCKING INSERT AND COVER INTERLOCK FOR CIRCUIT BREAKER by A. D. Carothers, D. A. Parks, R. E. White and W. G. Eberts.

BACKGROUND OF THE INVENTION

1. Field of the Invention

This invention relates to molded case circuit breakers and, more particularly, to a power drive mechanism, mechanically interlocked with a circuit breaker operating handle, which allows the circuit breaker handle to be controlled from a remote location. The power drive mechanism includes means for damping mechanical oscillations of the mechanism.

2. Description of the Prior Art

Molded case circuit breakers are generally old and well-known in the art. Examples of such circuit breakers are disclosed in U.S. Pat. Nos. 4,489,295; 4,638,277; 4,656,444 and 4,679,018. Such circuit breakers are generally used to protect electrical circuitry from damage due to an overcurrent condition, such as an overload and a relatively high level short circuit condition. An overload condition is normally 200 to 300 percent of the nominal current rating of the circuit breaker. A high level short circuit condition can be 1000 percent or more of the nominal current rating of the circuit breaker.

Molded case circuit breakers generally include at least one pair of separable main contacts which may be operated manually by way of an operating handle extending outwardly from the circuit breaker case or automatically in response to an overcurrent or high level short circuit condition. In the manual mode and one automatic mode of operation, the separable main contacts are opened by an operating mechanism which, in turn, is actuated by either an electronic trip unit in the automatic mode or the operating handle in the manual mode. In another automatic mode of operation, magnetic repulsion forces, generated between the stationary and movable contacts during relatively high level overcurrent conditions, can also cause the main contacts to be separated, independently of the operating mechanism.

The operating mechanism generally includes an overcenter toggle mechanism having relatively strong operating springs. In the manual mode of operation, sufficient force must be applied to the operating handle to overcome the opposing force of the operating springs from either an on or off position to the overcenter position. Once past the overcenter position, the force of the operating springs assist in driving the operating handle to the on or off position.

In some applications, a circuit breaker may be used primarily as a switch. In such applications, the circuit breakers are provided with either a solenoid operator or a motor operator, mechanically interlocked to the operating handle for alternatively driving the operating handle to the on position or off position. Examples of circuit breakers utilizing solenoid operators are disclosed in U.S. Pat. Nos. 4,553,115 and 4,642,726, assigned to the same assignee as the present invention. In such circuit breakers, a single solenoid operator is provided to drive the operating handle. However, such solenoid operators are relatively slow acting and generally not used when relatively fast switching is required as in the case of, for example, synchronizing a motor generator set with a live electrical bus. In such an application, the circuit breaker is disposed between the generator and the live electrical bus. When the generator is synchronized with the electrical bus, the circuit breaker must be closed relatively quickly. In such applications, a motor operator is generally used for switching the circuit breaker. Such motor operators generally include a high speed, high torque electric motor, mechanically coupled to the circuit breaker operating handle. In such applications, the operating springs in the circuit breaker operating mechanism work against the motor operator until the overcenter toggle mechanism in the circuit breaker passes the overcenter position. Once past the overcenter position, the operating springs assist the electric motor to cause the separable main contacts to either open or close. The motor operator also assists the operating springs in driving the operating handle to either the on or off position. However, once the operating handle reaches either the on or off position, it is necessary to turn the motor off and reset (e.g., reverse the direction of rotation) the motor for the next operation. Generally, limit switches are disposed at the on position and the off position for this purpose. These limit switches are actuated by a carriage assembly, mechanically coupled to the shaft of the motor. Due to the high speed and the large force at which the carriage assembly operates near the end of travel, a substantial amount of force is applied to these limit switches. Such force can necessitate the use of relatively expensive, heavy duty limit switches.

Furthermore, the carriage assembly oscillates after it engages a limit switch due to the force and speed of the carriage assembly causing the limit switch contacts to bounce. Since the limit switch controls the operation and the direction of rotation of the motor, this can cause erratic operation of the motor operator, thus preventing the circuit breaker from being accurately controlled.

SUMMARY OF THE INVENTION

It is an object of the present invention to provide a power drive mechanism for a circuit breaker operating handle which overcomes the problems associated with the prior art.

It is a further object of the present invention to provide a power drive mechanism for a circuit breaker operating handle which greatly reduces the instability of the carriage assembly at the end of travel.

It is another object of the present invention to provide a power drive mechanism for a circuit breaker operating handle which can be accurately controlled.

It is a further object of the present invention to provide a power drive mechanism for a circuit breaker operating handle which permits the circuit breaker to be switched at relatively fast speeds.

Briefly, the present invention relates to a power drive mechanism for a circuit breaker operating handle which includes a reversible electrical motor, a carriage assembly, mechanically coupled to the motor shaft, and a cooperating slide plate assembly. The carriage assembly includes a pivotally mounted L-shaped lever, mechanically interlocked with the circuit breaker operating handle, for moving the operating handle to an on position or alternatively to an off position on command. Microswitches are located at both the on position and the off position for controlling operation of the electric motor. The microswitches are actuated by the slide plate assembly which, in turn, is driven by the carriage assembly. The slide plate assembly is slidably mounted with respect to the carriage assembly with one or more wave washers to provide mechanical damping for the carriage assembly which minimizes damage to the microswitches. The slide plate assembly also prevents the contacts in the limit switch from bouncing even though the carriage assembly may oscillate at the end of travel.

DESCRIPTION OF THE DRAWING

These and other objects and advantages of the present invention will become readily apparent upon consideration of the following detailed description and attached drawing, wherein.

DETAILED DESCRIPTION

Figures 1, 2, 3:
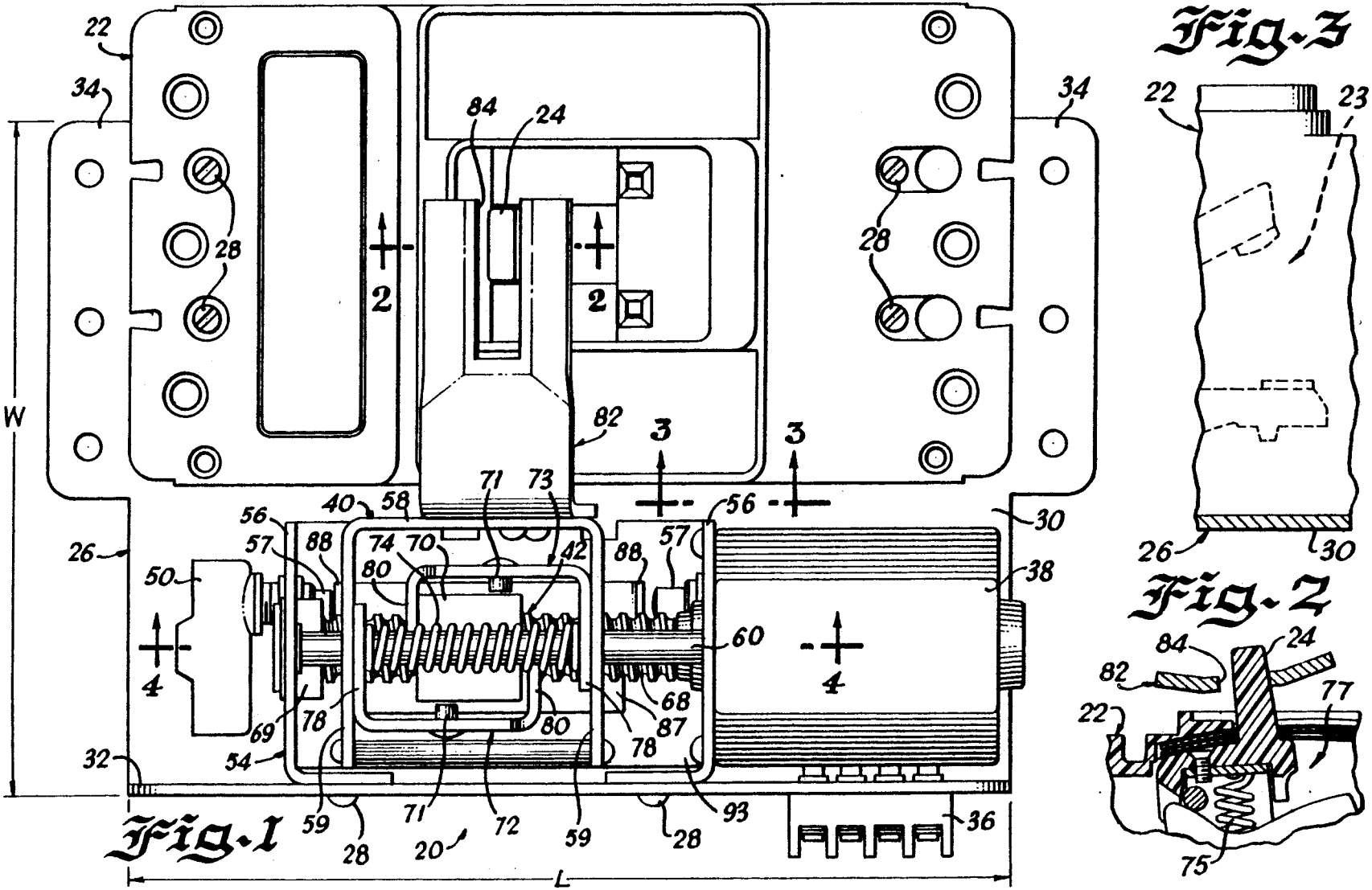
FIG. 1 is a plan view of a molded case circuit breaker and a power drive mechanism in accordance with the present invention.
FIG. 2 is a partial cross-sectional view taken along line 2—2 of FIG. 1.
FIG. 3 is a partial elevational view taken along line 3—3 of FIG. 1.

The power drive mechanism in accordance with the present invention, generally identified by the reference numeral 20, is for driving an operating handle of a molded case circuit breaker to an on position or alternatively to an off position. The power drive mechanism 20 is adapted to be disposed adjacent one side of a molded case circuit breaker 22 having an outwardly extending operating handle 24. The molded case circuit breaker 22 as well as the power drive mechanism 20 are rigidly secured to a fixture 26 with a plurality of fasteners 28. The fixture 26 is formed from sheet metal into an L-shaped member having a long leg 30 and a short leg 32. The length L (FIG. 1) of the long leg 30 is generally provided to correspond with the length of the circuit breaker 22 (FIG. 1) and the power drive mechanism 20. The width W (FIG. 1) of the long leg 30 is generally provided to allow the molded case circuit breaker 22 and the power drive mechanism 20 to be disposed side by side. The fixture 26 is provided with a pair of flanges 34 to allow the fixture 26 to be mounted to a circuit breaker housing (not shown). The short leg 32 of the fixture 26 is provided with an electrical connector 36 at one end to allow the power drive mechanism 20 to be connected to a remote control station (not shown) as will be discussed in more detail below.

As will be appreciated by those of ordinary skill in the art, the principles of the power drive mechanism 20 in accordance with the present invention is adapted to be utilized with virtually any molded case circuit breaker 22 having separable contacts 23 controllable by an outwardly extending operating handle 24. An example of such a circuit breaker 22 is disclosed in U.S. Pat. No. 4,642,430, assigned to the same assignee as the present invention and hereby incorporated by reference.

The power drive mechanism 20 in accordance with the present invention includes an electric motor 38, a carriage assembly 40, a rotary screw drive mechanism 42 and a slide plate assembly 44. The electric motor 38 is a reversible motor, and may be a universal motor, having an outwardly extending shaft 48. Once the electric motor 38 drives the operating handle 24 to either an on position or alternatively to an off position, the electric motor 38 must be stopped and the direction of the motor 38 reversed for the next operation. This is accomplished with limit switches 50 and 52 located near the end of the drive stroke of the screw drive mechanism 42, as will be discussed in more detail below.

The limit switches 50 and 52 contain electrical contacts that are electrically connected to the electric motor 38 and to the connector 36. The connector 36, in turn, is electrically connected to a remote control station to allow the circuit breaker 22 to either be turned on or turned off on command. Although the remote control station does not form a portion of the present invention, it will be understood by those of ordinary skill in the art that such a control station will include an external source of electrical power for driving the electric motor 38 as well as a selector switch and other electrical circuitry, for example, synchronizing circuitry.

The limit switches 50 and 52 are rigidly mounted to a generally U-shaped frame 54 having oppositely disposed leg portions 56. The frame 54 carries the electric motor 38, the carriage assembly 40, the rotary screw drive mechanism 42 and the slide plate assembly 44. More specifically, the electric motor 38 is securely fastened to one leg portion 56 of the frame 54 such that the motor shaft 48 is disposed between the leg portions 56. The carriage assembly 40, as will be discussed in detail below, is operatively coupled to the rotary screw drive mechanism 42 and is also disposed between the leg portions 56. The limit switches 50 and 52 are secured to the leg portions 56 such that their actuating buttons 57 are disposed facing each other.

The carriage assembly 40 is slidably mounted for reciprocal movement with respect to the frame 54. The carriage assembly 40 includes a U-shaped carriage 58 having depending legs 59 and one or more stabilizing axles 60. The stabilizing axles 60 allow the carriage 58 to be slidably mounted with respect to the frame 54. For purposes of discussion, two stabilizing axles 60 are described and illustrated although the invention is not intended to be so limited. The stabilizing axles 60 are disposed generally parallel to the longitudinal axis of the frame 54, above and below the rotary screw drive mechanism 42. The ends of the stabilizing axles 60 are received in apertures 62 provided in the leg portions 56 of the frame 54. The depending legs 59 of the carriage 58 are also provided with apertures 66, aligned with the apertures 62 for receiving the stabilizing axles 60.

The rotary screw drive mechanism 42 includes a worm gear 68, rigidly disposed about and fixed to the motor shaft 48 and carried at one end by a bearing, disposed in a bearing housing 69 in a leg portion 56 of the frame 54. A worm gear follower 70 is formed from a block-shaped member, which may have a threaded bore or other means to allow the worm gear follower 70 to move back and forth as the motor shaft 48 is rotated. The worm gear follower 70 cooperates with a pair of drive yokes 72 and 73, operatively coupled to the carriage 58. In order to prevent rotation of the worm gear follower 70, pins 71 are disposed on the drive yokes 72 and 73, which engage a flat surface of the worm gear follower 70 to prevent it from rotating in either direction. The worm gear follower 70 is operatively coupled to the drive yokes 72 and 73 by way of one or more springs 74, disposed about the stabilizing axles 60. The springs 74 are disposed between the two drive yokes 72 and 73. The drive yokes 72 and 73 are provided with apertures 76, aligned with the apertures 62 and 66 for receiving the stabilizing axles 60 to allow the drive yokes 72 and 73 to be slidably mounted with respect to the frame 54.

The drive yokes 72 and 73 are generally U-shaped members having an engagement arm portion 78 and a drive arm portion 80. The engagement arm portion 78 is adapted to engage a depending leg 59 of the carriage 58. The drive arm portions 80 are driven by the worm gear follower 70. The drive yokes 72 and 73 are disposed within the carriage 58 such that the drive arms 80 are interleaved as shown in FIG. 1 with the worm gear follower 70 disposed therebetween.

Figure 4:
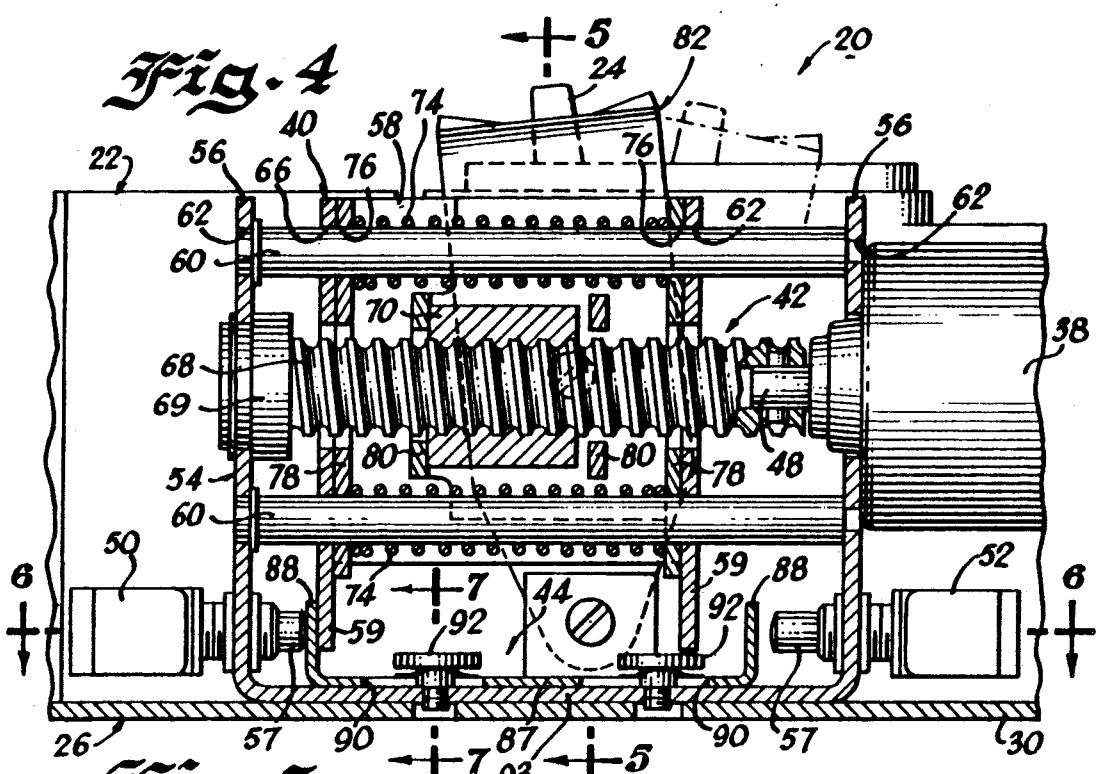
FIG. 4 is a cross-sectional view taken along line 4—4 of FIG. 1.
Figure 6:
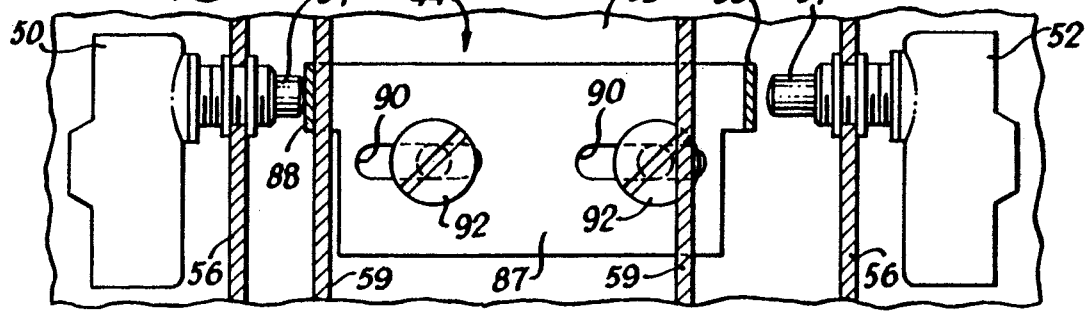
FIG. 6 is a plan sectional view taken along line 6—6 of FIG. 4.

Referring to FIGS. 1 and 4, the carriage assembly 40 is shown in its extreme left position. In operation, when the carriage assembly 40 moves to the right, the worm gear follower 70 engages the drive arm portion 80 of the left drive yoke 72. Similarly, the drive arm portion 80 of the right drive yoke 73 is driven by the worm gear follower 70 when the direction of travel is to the left. Since the two drive yokes 72 and 73 are interleaved and mechanically coupled by way of the springs 74, movement of the left drive yoke 72 causes the right drive yoke 73 to engage an inner surface of the carriage 58 to advance the carriage 58 along the path of travel. As the left drive yoke 72 advances to the right, it forces the springs 74 to move to the right. Since the springs 74 are disposed between the drive yokes 72 and 73, the springs 74 cause the right drive yoke 73 to move to the right. Since the engagement arm 78 of the right drive yoke 73 is in engagement with the carriage 58, this action will cause the carriage 58 to advance to the right. Once the carriage 58 reaches the end of travel position, the electric motor 38 is cut off and the direction of rotation of the motor 38 is reversed for a subsequent operation by the limit switches 50 or 52. The operation in the opposite direction (e.g., left) is similar. In order to account for any overtravel in the carriage assembly 40 that may result from the inertia of the electric motor 38 after it is shut off, the springs 74 may compress, drawing the two drive yokes 72 and 73 relatively closer to each other.

An L-shaped operating lever 82 is pivotally connected to the carriage 58. The L-shaped lever 82 is provided with a slot 84 for capturing the operating handle 24. Since the L-shaped lever 82 is pivotally connected to the carriage 58, the lever 82 will drive the operating handle 24 to the on position or alternatively the off position as the carriage assembly 40 is advanced by the rotary screw drive mechanism 42. The travel of the lever 82 is limited in both directions by the operating handle 24 which, in turn, is limited by the design of the circuit breaker 22.

Once the power drive mechanism 20 is actuated, the electric motor 38 and the springs 74 oppose the internal operating springs 75 in the operating mechanism 77 of the circuit breaker 22 until an overcenter toggle mechanism within the circuit breaker 22 reaches its overcenter position. Once past the overcenter position, the operating springs 75 assist the power drive mechanism 20 in completing the stroke. Because of the amount of force in the carriage assembly 40 near the end of a drive stroke, a slide plate assembly 44 is provided to absorb some of the energy in the carriage assembly 40 at the end of travel and also to prevent contact bounce in the limit switches 50 and 52. The slide plate assembly 44 includes a slide plate 87 with a pair of oppositely disposed actuation arms 88. The outward surface of each actuation arm 88 is adapted to engage the actuation buttons 57 of the limit switches 50 and 52. The inner surface of the actuation arms 88 is adapted to cooperate with the depending arms 59 of the carriage assembly 40.

The slide plate 87 is provided with a pair of slots 90 for receiving fasteners 92, such as shoulder screws, to allow the slide plate 87 to be slidably attached to a base 93 of the frame 54. In order to provide mechanical damping of the carriage assembly 40 near the end of travel, the slide plate 87 is provided with wave washers 94. The wave washers 94 are disposed between the slide plate 87 and the shoulder screw 92.

Figure 5:
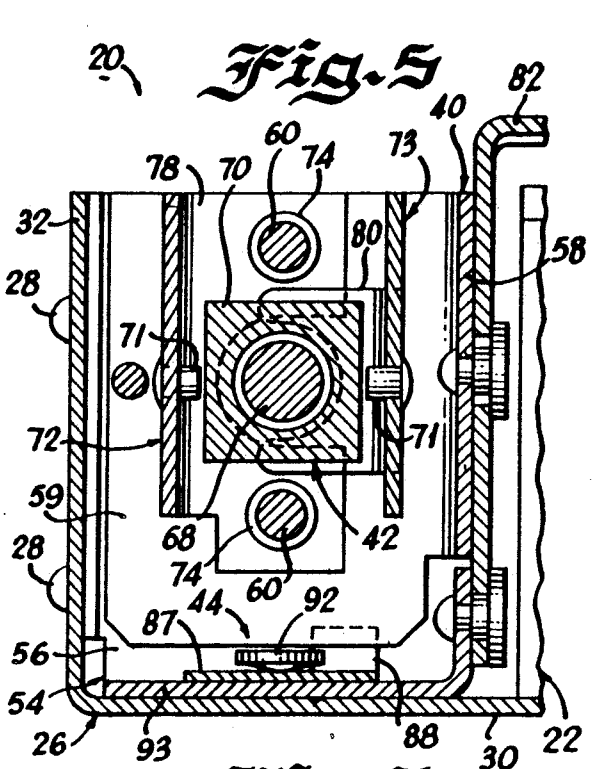
FIG. 5 is a transverse cross-sectional view taken along line 5—5 of FIG. 4.
Figure 7:
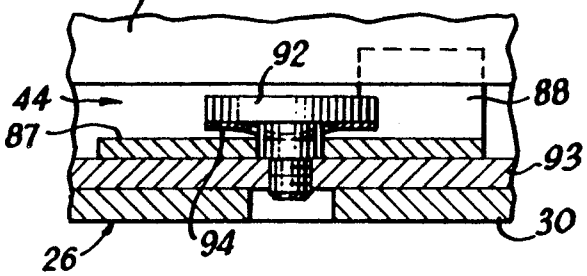
FIG. 7 is an enlarged cross-sectional view taken along line 7—7 of FIG. 4.

The length of the slide plate 87 is such that only one actuation arm 88 will engage a limit switch 50 or 52 at a time. In operation, the slide plate 87 will release one limit switch 50 or 52 before the other limit switch 50 or 52 is actuated. Thus, referring to FIGS. 4 and 5, as the carriage assembly 40 moves to the right, the limit switch 50 will be released just before the limit switch 52 is actuated. Once the limit switch 50 is released, electrical power to the electric motor 38 will cut off. When the limit switch 52 is actuated, the electric motor 38 will be reset for operation in the opposite direction. After the slide plate 87 actuates the limit switch 52, it will maintain the limit switch 52 actuated even though the carriage assembly 42 may oscillate, thus preventing contact bounce in the limit switch 52. Thus, the slide plate assembly is able to allow the electric motor 38 to be accurately controlled.

Obviously many modifications and variations of the present invention are possible in light of the above teachings. Thus, it is to be understood that, within the scope of the appended claims, the invention may be practiced otherwise than as specifically described hereinabove.

What is claimed and desired to be secured by a Letters Patent is:

1. A circuit breaker comprising:
a housing;
a pair of separable main contacts, carried in said housing;
an operating mechanism within such housing, operatively coupled to said pair of separable main contacts;
an operating handle extending outwardly from said housing, operatively coupled to said operating mechanism, said operating handle being placed in an on position or alternatively in an off position for causing said separble main contacts to be accordingly closed or opened respectively;
driving means operatively coupled to said operating handle for movement through a span of travel for driving the operating handle to its on position or alternatively to its off position on command; and
damping means for damping mechanical oscillations in said driving means at the end of said span of travel in each direction.

2. A circuit breaker as recited in claim 1, wherein said driving means includes an electric motor having a motor shaft and a carriage assembly operatively coupled to said motor shaft, said carriage assembly adapted for reciprocal movement between a first position and a second position.

3. A circuit breaker as recited in claim 2, wherein said driving means includes a rotary screw drive mechanism, rigidly coupled to the motor shaft and operatively coupled to said carriage assembly.

4. A circuit breaker as recited in claim 2, wherein said damping means includes a slide plate and coupling means for slidably mounting said slide plate with respect to said carriage assembly.

5. A circuit breaker as recited in claim 4, wherein said coupling means includes one or more wave washers.

6. A circuit breaker comprising:
a housing;
separable main contacts in said housing;
an operating mechanism within said housing, operatively coupled to said separable main contacts;
an operating handle extending outwardly from said housing operatively coupled to said operating mechanism, said operating handle being placed in an on position or alternatively in an off position for causing said separable main contacts to be accordingly closed or opened respectively;
driving means operatively coupled to said operating handle for driving the operating handle to said on position and alternatively to said off position; said driving means including an electric motor having a motor shaft, a carriage assembly movably mounted between a first position and a second position, means for coupling said carriage assembly to said motor shaft and damping means for damping mechanical oscillation of the carriage assembly, said damping means including a slide plate slidably mounted to said carriage assembly with one or move wave washers.

7. A circuit breaker as recited in claim 6, wherein said driving means includes an operating lever pivotally connected to said carriage assembly.

8. A circuit breaker as recited in claim 6, further including reversing means for reversing the direction of the motor after each operation.

9. A circuit breaker as recited in claim 8, wherein said reversing means includes a limit switch disposed at one or the other of the off position or the on position.

10. A circuit breaker as recited in claim 9, wherein said reversing means includes a limit switch disposed at the other of said on position or said off position.

11. A circuit breaker as recited in claim 9, wherein said limit switch is a microswitch.

12. A circuit breaker as recited in claim 6, wherein said driving means includes a rotary screw drive, mechanically coupled to said motor shaft and said carriage assembly.

13. A circuit breaker as recited in claim 6, further including reversing means for reversing the direction of rotation of said motor.

14. A circuit breaker as recited in claim 6, further including a carrier for carrying said circuit breaker and said driving means.

* * * * *